US010361494B2

(12) United States Patent
Wu et al.

(10) Patent No.: US 10,361,494 B2
(45) Date of Patent: Jul. 23, 2019

(54) WIRE CONNECTION TERMINAL STRUCTURE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wei-Chi Chen, New Taipei (TW); Cheng-Wei Chen, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/838,708

(22) Filed: Dec. 12, 2017

(65) Prior Publication Data

US 2018/0175516 A1 Jun. 21, 2018

(30) Foreign Application Priority Data

Dec. 19, 2016 (TW) ..... 105141987 A

(51) Int. Cl.

| | |
|---|---|
| ***H01R 12/51*** | (2011.01) |
| ***H01R 4/48*** | (2006.01) |
| ***H01R 13/631*** | (2006.01) |
| ***H01R 4/60*** | (2006.01) |
| *H01R 43/16* | (2006.01) |

(52) U.S. Cl.

CPC ..... *H01R 4/60* (2013.01); *H01R 4/4818* (2013.01); *H01R 12/515* (2013.01); *H01R 13/631* (2013.01); *H01R 43/16* (2013.01)

(58) Field of Classification Search

CPC ..... H01R 4/4818; H01R 4/60; H01R 12/515; H01R 13/11; H01R 13/113; H01R 13/114; H01R 13/187; H01R 13/193; H01R 13/631; H01R 43/16

USPC ..... 439/439–441, 852, 861

See application file for complete search history.

(56) References Cited

U.S. PATENT DOCUMENTS

| | | | | |
|---|---|---|---|---|
| 6,062,918 | A * | 5/2000 | Myer | H01R 13/187 439/833 |
| 6,796,855 | B2 * | 9/2004 | Fricke | H01R 4/4818 439/835 |
| 6,814,598 | B2 * | 11/2004 | Hoffmann | H01R 12/58 439/249 |
| 7,004,781 | B2 * | 2/2006 | Walter | H01R 4/4836 439/268 |

(Continued)

*Primary Examiner* — Edwin A. Leon
*Assistant Examiner* — Oscar C Jimenez
(74) *Attorney, Agent, or Firm* — Rosenberg, Klein & Lee

(57) ABSTRACT

A wire connection terminal structure includes a terminal main body and a stopper member. One end of the terminal main body is formed with a connection section. Two support legs extend from the connection section for securely connecting with a preset circuit board. The connection section defines a socket. An elastic abutment plate obliquely extends from the connection section between the two support legs. A locating section is disposed at one end of each support leg. The stopper member is securely connected to the support legs via the locating sections. A stop face is formed on one side of one end of the stopper member proximal to the connection section and positioned in the moving path of the elastic abutment plate when elastically deformed. After the elastic abutment plate is forced, the deformation amount of the elastic abutment plate is restricted by the stop face.

36 Claims, 7 Drawing Sheets

(56) References Cited

U.S. PATENT DOCUMENTS

| | | | | |
|---|---|---|---|---|
| 7,997,915 | B2 * | 8/2011 | Pueschner | H01R 4/4818 439/268 |
| 8,251,738 | B2 * | 8/2012 | Heckert | H01R 4/4836 439/441 |
| 8,764,459 | B2 * | 7/2014 | Decker | H01R 4/4818 439/83 |
| 9,263,822 | B2 * | 2/2016 | Wu | H01R 13/2407 |
| 9,624,951 | B2 * | 4/2017 | Wu | F16B 2/22 |
| 2013/0095697 | A1 * | 4/2013 | Wu | H01R 4/4827 439/625 |
| 2014/0242833 | A1 * | 8/2014 | Mostoller | H01R 4/4836 439/438 |
| 2014/0370738 | A1 * | 12/2014 | Wu | H01R 4/4827 439/357 |
| 2015/0357728 | A1 * | 12/2015 | Chen | H01R 4/48 439/725 |
| 2016/0240970 | A1 * | 8/2016 | Wu | H01R 4/4836 |

* cited by examiner

WIRE CONNECTION TERMINAL STRUCTURE

BACKGROUND OF THE INVENTION

1. Field of the Invention

The present invention relates generally to a wire connection terminal structure, and more particularly to a wire connection terminal structure, which can prevent the elastic abutment plate from permanent deformation when the conductive wire is plugged in by an improper angle so that the conductive wire can be reliably and effectively located without outward loosening or detachment.

2. Description of the Related Art

There are many types of wire connection terminals applied to the circuit board for connecting with conductive wires. FIG. 1 shows one of the most often seen terminal structures. The terminal structure mainly includes a terminal main body 10 and an insulation housing 2. The terminal main body 10 is made of a metal plate by means of punching and thereafter bending. One end of the terminal main body 10 is formed with a connection section 101. The terminal main body 10 further has two support legs 104 extending from two lateral sides of the connection section 101 to the other end of the terminal main body 10 in parallel to each other. One end of each support leg 104 is formed with a connecting section 105 outward bent from the support leg 104. The connecting section 105 is soldered on a preset circuit board (or another connection plane face). The connection section 101 defines a socket 102 passing through the connection section 101. The terminal main body 10 further has an elastic abutment plate 103 obliquely extending from an outer side of the connection section 101 into a space between the two support legs 104.

The housing 2 is fitted around the terminal main body 10 to provide an insulation and protection effect. One end of the housing 2 is formed with a perforation 21 in alignment with the socket 102. Two lateral sides of the other end of the housing 2 are respectively formed with lateral notches 22 for the connecting sections 105 to pass through.

In use, an external conductive wire 4 is plugged through the perforation 21 and the socket 102 to extend between the two support legs 104. At this time, the conductive wire 4 will push the elastic abutment plate 103 outward. After the conductive wire 4 passes through the elastic abutment plate 103, the elastic abutment plate 103 will elastically restore to abut against the conductive wire 4 and tightly press the conductive wire 4 against the inner wall of the socket 102. Under such circumstance, the conductive wire 4 is prevented from outward loosening or detaching from the socket 102 under external extraction force.

However, in practice, during the process that an operator plugs the external conductive wire 4 through the perforation 21 into the socket 102, due to the factors of negligence, improper operation or judgment error of the operator, the operator often fails to plug the conductive wire 4 into the socket 102 by a correct (upright) and fixed angle. When the conductive wire 4 is obliquely plugged into the socket 102 in a direction to the elastic abutment plate 103 (as shown in FIG. 2), the elastic abutment plate 103 is directly pushed by the conductive wire 4 and elastically deformed. The entire structure of the terminal lacks a system for stopping the elastic abutment plate 103 from laterally over-biasing. As a result, the elastic abutment plate 103 is often over-biased with an excessively great elastic deformation amount (over the yield point). In this case, the elastic abutment plate 103 will permanently deform under elastic fatigue. Accordingly, the elastic abutment plate 103 can hardly keep extending into the socket 102 to elastically press the conductive wire 4 (as shown in FIG. 3). As a result, after the conductive wire 4 passes through the socket 102 and fully extends into the space between the two support legs 104, the elastic abutment plate 103 can hardly press the conductive wire 4 against the inner wall of the socket 102. Under such circumstance, the conductive wire 4 is easy to loosen or detach from the socket 102 under external extraction force.

A solution to the above problem is to increase the depth or length of the perforation 21 of the housing 2 (or partially increase the height of one side of the perforation 21 distal from the elastic abutment plate 103) so as to prevent the conductive wire 4 from being plugged into the perforation 21 by an angle inclined from the axial direction of the socket 102. In this case, the conductive wire 4 can be guided and plugged into the socket 102 in a direction more approximate to the axial direction of the socket 102 to push and bias the elastic abutment plate 103. Accordingly, the elastic abutment plate 103 is prevented from being over-deformed so that the elastic abutment plate 103 can keep the ability to press the conductive wire 4. However, such structure will affect the appearance and size of the entire housing 2 and can hardly meet the requirement of a user (or a client).

Another solution to the above problem is to directly form a stop section on the terminal main body 10 or the housing 2 in the moving path of the elastic abutment plate 103 so as to restrict the lateral elastic deformation amount of the elastic abutment plate 103. Under such circumstance, the elastic abutment plate 103 is prevented from being over-biased with an excessively great elastic deformation amount (over the yield point) to cause permanent deformation. However, in practice, it is quite difficult to form the stop section and such design is not optimal.

It is therefore tried by the applicant to provide a wire connection terminal structure to solve the above problem.

SUMMARY OF THE INVENTION

It is therefore a primary object of the present invention to provide a wire connection terminal structure, which includes a terminal main body and a stopper member. One end of the terminal main body is formed with a connection section. The connection section defines a socket passing through the connection section. Two support legs extend from the connection section along the direction of the socket. An elastic abutment plate obliquely extends from the connection section between the two support legs. A locating section is disposed at one end of each support leg distal from the connection section. The stopper member is securely connected to the lateral sides of the two support legs via the locating sections. A stop face is formed on one side of one end of the stopper member proximal to the connection section and positioned in the moving path of the elastic abutment plate when elastically deformed. After the elastic abutment plate is forced, the deformation amount of the elastic abutment plate is restricted by the stopper face. Therefore, the elastic abutment plate is prevented from being over-deformed to cause permanent deformation. In this case, the elastic abutment plate can reliably and effectively elastically abut against the conductive wire plugged in the socket to prevent the conductive wire from outward loosening or detaching.

It is a further object of the present invention to provide the above wire connection terminal structure, in which the stopper member is securely connected with the ends of the two support legs distal from the connection section, whereby the stopper member cooperates with the connection section to enhance the structural strength of the entire terminal main body. In this case, when the conductive wire is plugged into the socket to apply an action force to the connection section, the swinging and unstable condition of the two support legs can be improved.

To achieve the above and other objects, the wire connection terminal structure of the present invention includes a terminal main body and a stopper member. One end of the terminal main body is formed with a connection section. Two support legs extend from two lateral sides of the connection section to the other end of the terminal main body in parallel to each other. The support legs are securely connected on a preset plane face. The connection section defines a socket passing through the connection section. An elastic abutment plate obliquely extends from an outer side of the connection section into a space between the two support legs. A locating section is disposed at one end of each support leg distal from the connection section. The locating section protrudes to a lateral side of the elastic abutment plate. The stopper member is securely connected to the lateral sides of the two support legs via the locating sections. A stop face is formed at one end of the stopper member proximal to the connection section. The stop face is directed to the two support legs and positioned in the moving path of the elastic abutment plate when elastically deformed. After the elastic abutment plate is forced, the deformation amount of the elastic abutment plate is restricted by the stopper face.

In the above wire connection terminal structure, the locating section is a protrusion structure. Each of two sides of the stopper member is formed with a recess corresponding to the locating section.

The locating section passes through the recess and then transversely bends, whereby the stopper member is securely connected between the middles of the two support legs.

In the above wire connection terminal structure, a channel is formed on one face of the stopper member distal from the two support legs in communication with the two recesses, whereby the locating section passes through the recess and then bends to extend into the channel.

In the above wire connection terminal structure, a (protruding) back section is disposed on one face of the stopper member distal from the two support legs. The back section is positioned between the two recesses.

In the above wire connection terminal structure, a guide slope is formed at the middle of one face of the stopper member, which faces the socket.

In the above wire connection terminal structure, each support leg is formed with a connecting section outward bent from the support leg for connecting on the preset plane face.

In the above wire connection terminal structure, an insulation housing is fitted around the terminal main body. One end of the housing is formed with a perforation in alignment with the socket. Two lateral sides of the other end of the housing are formed with lateral notches for the support legs to pass through and outward extend.

In the above wire connection terminal structure, the terminal main body is made of a metal plate by means of punching and thereafter bending.

The present invention can be best understood through the following description and accompanying drawings, wherein:

DETAILED DESCRIPTION OF THE PREFERRED EMBODIMENTS

Figure 1:
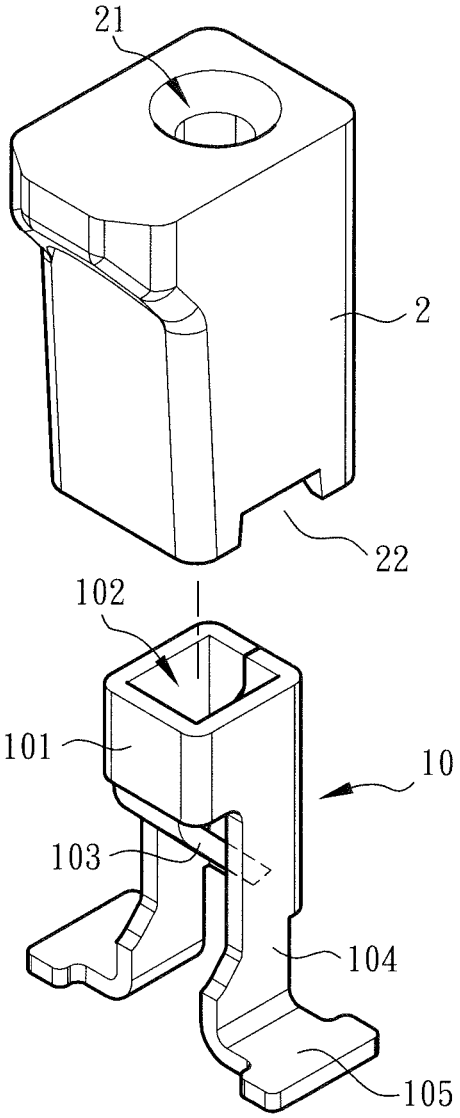
Fig. 1 PRIOR ART
FIG. 1 is a perspective exploded view of a conventional wire connection terminal structure applied to a circuit board for connecting with a conductive wire.
Figure 2:
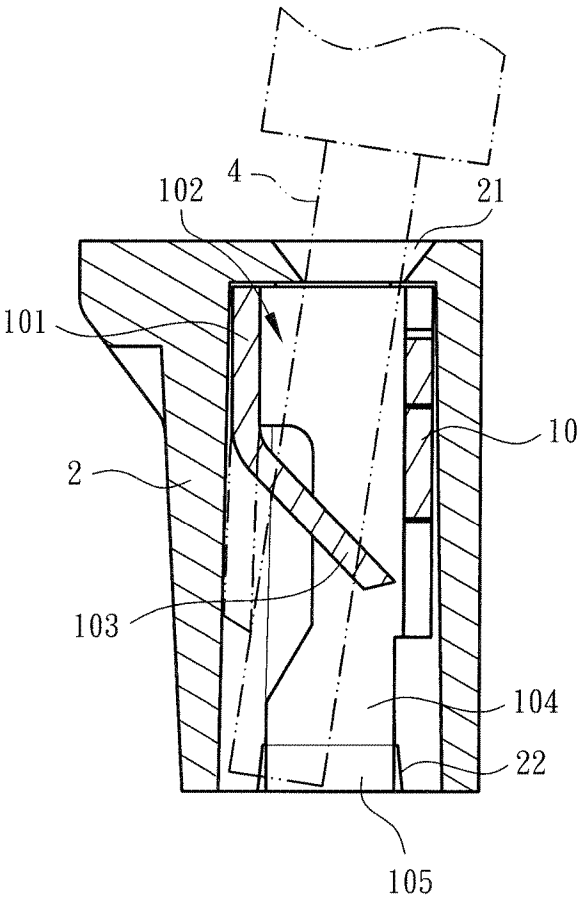
Fig. 2 PRIOR ART
FIG. 2 is a sectional assembled view of the conventional wire connection terminal structure according to FIG. 1, showing that a conductive wire is obliquely plugged into the socket of the terminal structure.
Figure 3:
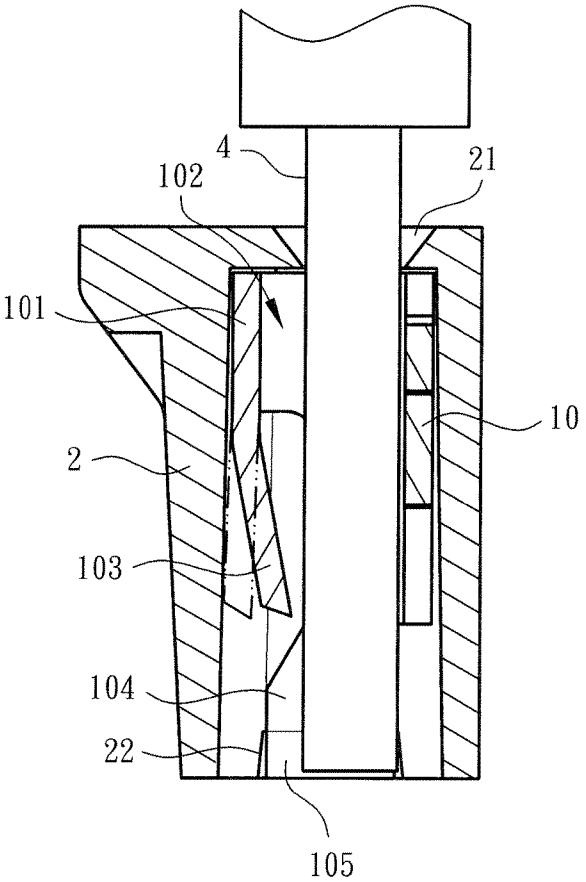
Fig. 3 PRIOR ART
FIG. 3 is a sectional assembled view according to FIG. 2, showing that the elastic abutment plate is over-deformed to lose the ability to press the conductive wire plugged in the socket of the terminal structure.
Figure 4:
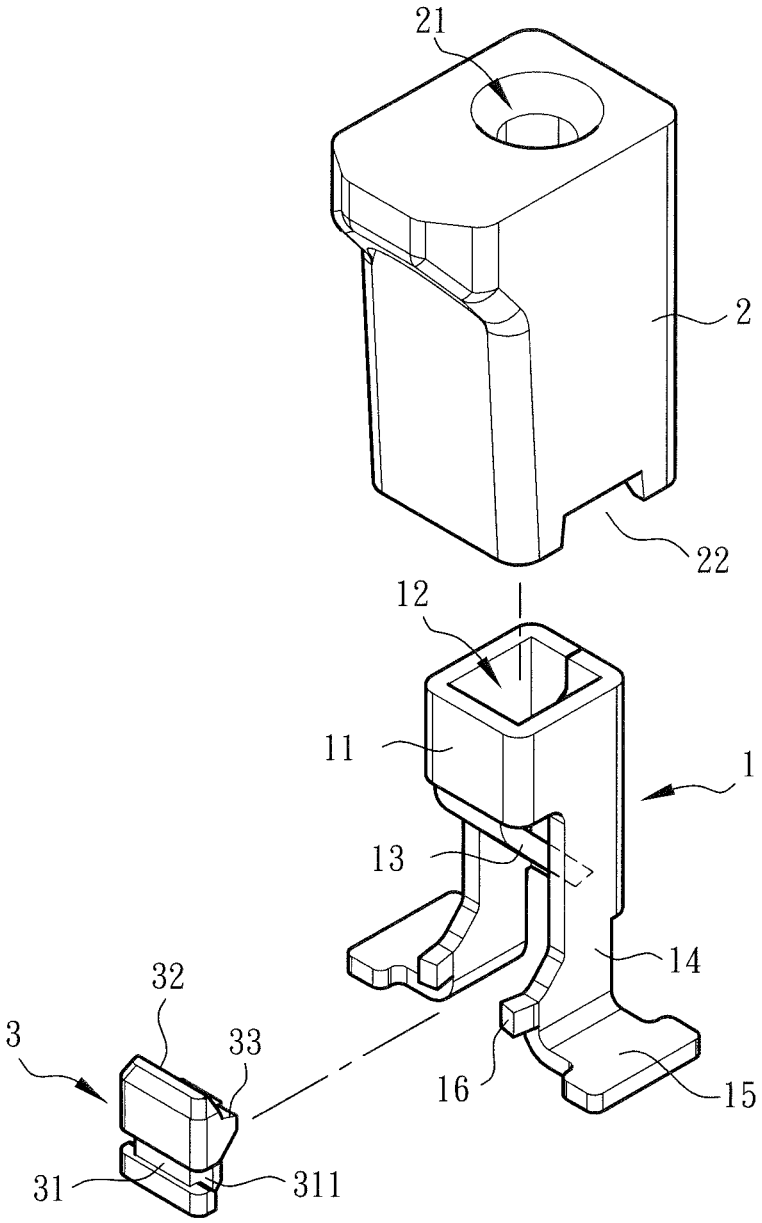
FIG. 4 is a perspective exploded view of the wire connection terminal structure of the present invention.
Figure 5:
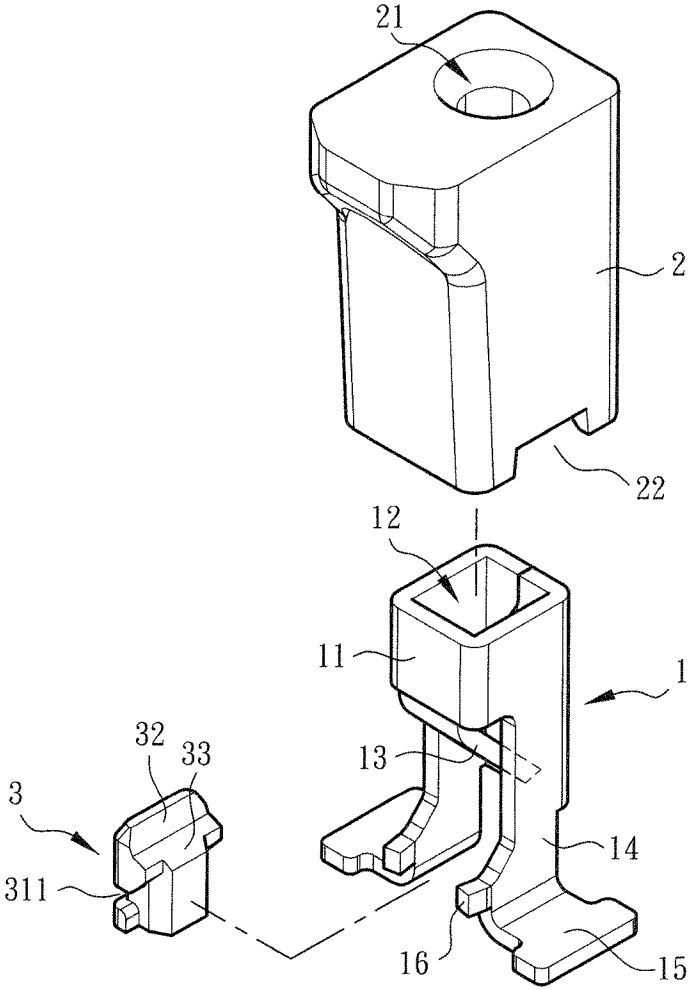
FIG. 5 is another perspective exploded view of the wire connection terminal structure of the present invention.
Figure 6:
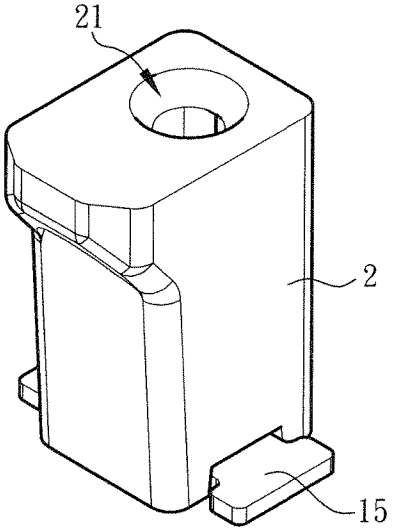
FIG. 6 is a perspective assembled view of the wire connection terminal structure of the present invention.
Figure 8:
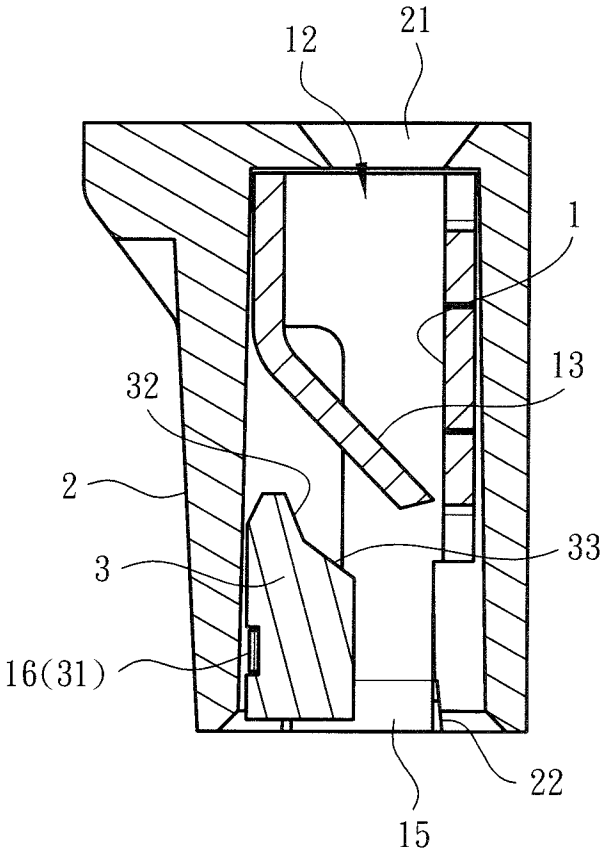
FIG. 8 is a side sectional assembled view of the wire connection terminal structure of the present invention.
Figure 7:
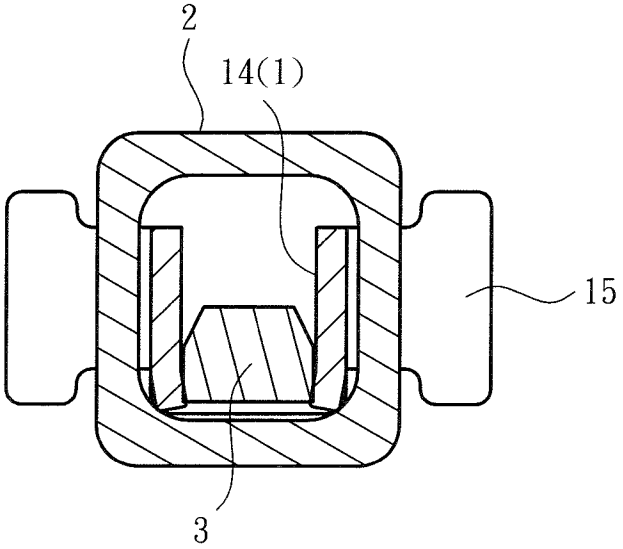
FIG. 7 is a top sectional assembled view of the wire connection terminal structure of the present invention.

Please refer to FIGS. 4 to 8. The wire connection terminal structure of the present invention includes a terminal main body 1 and a stopper member 3. The terminal main body 1 is made of a metal plate by means of punching and thereafter bending. One end of the terminal main body 1 is formed with a connection section 11. The terminal main body 1 further has at least one support leg 14 (there are two support legs 14 in the drawings) extending from the connection section 11 to the other end of the terminal main body 1. The connection section 11 defines a socket 12. In addition, the terminal main body 1 has an elastic abutment plate 13 obliquely extending from the connection section 11 into the socket 12 (between the two support legs 14 as shown in the drawings). An end section of each support leg 14 is formed with a connecting section 15 outward bent from the support leg 14. The connecting section 15 is connected (soldered) with a preset plane face (circuit board) or a wire connection section. In addition, a locating section 16 is disposed at one end of the support leg 14 proximal to the connecting section 15. The locating section 16 is a protrusion structure protruding to a lateral side of the elastic abutment plate 13.

The stopper member 3 is securely connected to the middle of the support leg 14 of the terminal main body via the locating section 16. In a preferred embodiment, each of two sides of the stopper member 3 is formed with a recess 311 corresponding to the locating section 16. In addition, a channel 31 is formed on one face of the stopper member 3 distal from the two support legs 14 in communication with the two recesses 311. The locating section 16 passes through the recess 311 and then transversely bends to extend into the channel 31, whereby the stopper member 3 is securely connected between the middles of the two support legs 14.

A stop face 32 is formed on one side of one end of the stopper member 3 proximal to the connection section 11 and directed to the socket 12. The stop face 32 is positioned in the moving path of the elastic abutment plate 13 when elastically deformed. In addition, a guide slope 33 is formed at the middle of one face of the stopper member 3, which faces the socket 12. The inclination direction of the guide slope 33 is approximately identical to the extending direction of the elastic abutment plate 13.

In a preferred embodiment, an insulation housing 2 is fitted around the terminal main body 1 as necessary. One end of the housing 2 is formed with a perforation 21 in alignment with the socket 12. Two lateral sides of the other end of the housing 2 are formed with lateral notches 22 for the support legs 14 to pass through and outward extend.

Figure 10:
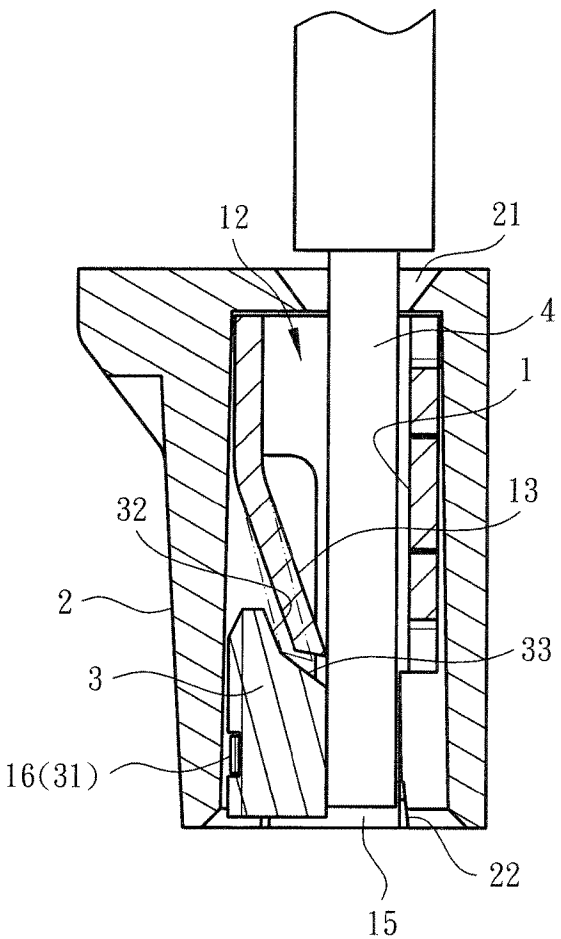
FIG. 10 is a side sectional assembled view according to FIG. 9, showing that the elastic abutment plate elastically restores to press the conductive wire plugged in the socket of the terminal structure.
Figure 9:
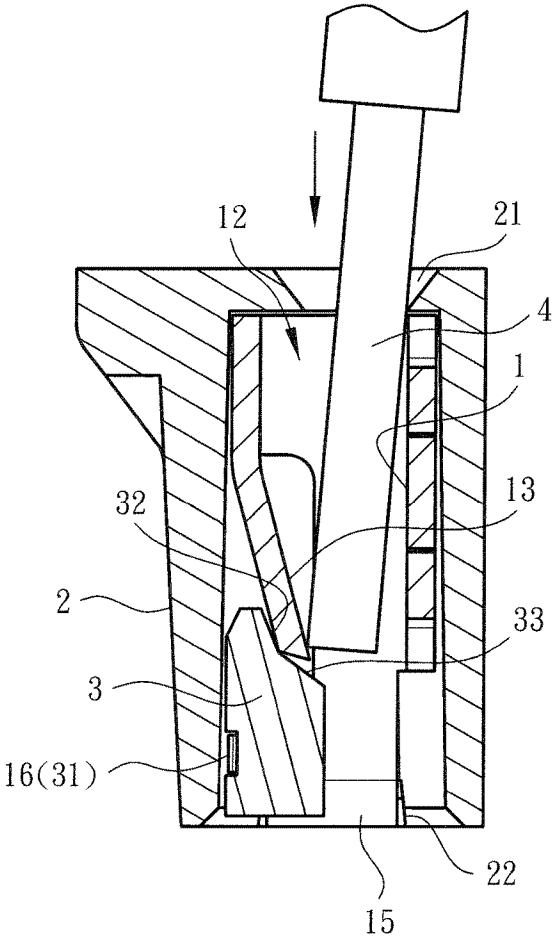
FIG. 9 is a side sectional assembled view according to FIG. 8, showing that an external conductive wire is obliquely plugged into the socket of the terminal structure and the stopper member restricts the elastic abutment plate from being over-biased.

Please now refer to FIGS. 9 and 10. In actual application of the present invention, an external conductive wire 4 can be directly obliquely plugged through the perforation 21 into the socket 12 in a direction to the elastic abutment plate 13 inside the socket 12. At this time, the conductive wire 4 will push the elastic abutment plate 13 to a preset extent. Thereafter, the elastic abutment plate 13 is restricted by the stop face 32 of the stopper member 3 from being further deformed and biased. Accordingly, the deformation amount of the elastic abutment plate 13 will keep under the yield point without permanent deformation.

After the oblique conductive wire 4 passes through the elastic abutment plate 13, the conductive wire 4 will directly abut against the guide slope 33, whereby the guide slope 33 will guide the conductive wire 4 to further move downward to be located between the support legs 14 and the stopper member 3 and the terminal main body 1. At this time, the elastic abutment plate 13 will elastically restore to abut against the conductive wire 4 and tightly press the conductive wire 4 against the inner wall of the socket 12. Under such circumstance, the conductive wire 4 is securely held and located without easy loosening or detachment under external extraction force.

In the wire connection terminal structure of the present invention, the stopper member 3 is securely connected with the ends of the two support legs 14 distal from the connection section 11, (that is, proximal to the circuit board). Therefore, the stopper member 3 can enhance the structural strength between the two support legs 14. In this case, when the conductive wire 4 is plugged into the socket 12 to apply an action force to the connection section 11, the swinging and unstable condition of the two support legs 14 are reduced and improved.

Figure 11:
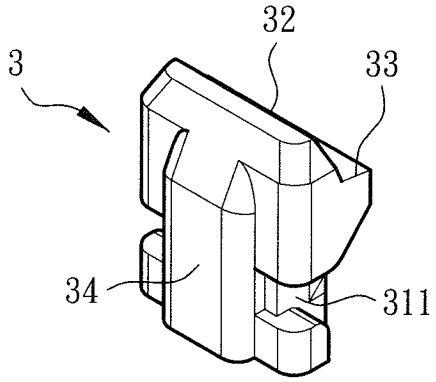
FIG. 11 is a perspective view of another embodiment of the stopper member of the wire connection terminal structure of the present invention.

Please now refer to FIG. 11, which shows a modified embodiment of the stopper member 3. In this embodiment, a (protruding) back section 34 is disposed on one face of the stopper member 3 distal from the two support legs 14. The back section 34 is positioned between the two recesses 311 and serves to enhance the frictional interference between the stopper member 3 and the housing 2. Under such circumstance, the terminal main body 1 and the housing 2 can be more securely assembled with each other.

In conclusion, the wire connection terminal structure of the present invention can truly prevent the elastic abutment plate from being over-deformed when the conductive wire is plugged in by an improper angle so that the conductive wire can be reliably and effectively located. The wire connection terminal structure of the present invention is inventive and advanced.

The above embodiments are only used to illustrate the present invention, not intended to limit the scope thereof. Many modifications of the above embodiments can be made without departing from the spirit of the present invention.

What is claimed is:

1. A wire connection terminal structure comprising:

a terminal main body, one end of the terminal main body being formed with a connection section, the terminal main body further having at least one support leg extending from the connection section to the other end of the terminal main body, the support leg being securely connected to a preset wire connection section, the connection section defining a socket, the terminal main body further having an elastic abutment plate obliquely extending from the connection section, the support leg being formed with a locating section; and a stopper member securely connected to the support leg via the locating section, the stopper member being positioned in a moving path of the elastic abutment plate when elastically biased and deformed by insertion of a wire into the socket, whereby deformation of the elastic abutment plate is limited to an amount of deformation the stopper member that is less than a yield point of the elastic abutment plate to prevent permanent deformation thereof.

2. The wire connection terminal structure as claimed in claim 1, wherein the terminal main body has two support legs and the socket communicates with a space between the two support legs, the elastic abutment plate obliquely extending between the two support legs.

3. The wire connection terminal structure as claimed in claim 2, wherein the locating section is a protrusion structure protruding to the elastic abutment plate, each of two sides of the stopper member being formed with a recess corresponding to the locating section, the protrusion structure passes through the recess and then transversely bending and embracing a rear face of the stopper member, whereby the stopper member is securely connected between the middles of the two support legs.

4. The wire connection terminal structure as claimed in claim 3, wherein a channel is formed on the rear face of the stopper member distal from the two support legs and in communication with the two recesses, whereby the protrusion structure passes through the recess and then bends to extend into the channel.

5. The wire connection terminal structure as claimed in claim 4, wherein a stop face is formed on the stopper member and directed to a biasing path of the elastic abutment plate, a guide slope being formed at the middle of one face of the stopper member, which faces the socket for deflecting the wire inserted into the socket into the space between the two support legs.

6. The wire connection terminal structure as claimed in claim 5, wherein each support leg is formed with a connecting section outwardly bent from the support leg.

7. The wire connection terminal structure as claimed in claim 5, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

8. The wire connection terminal structure as claimed in claim 4, wherein each support leg is formed with a connecting section outwardly bent from the support leg.

9. The wire connection terminal structure as claimed in claim 8, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

10. The wire connection terminal structure as claimed in claim 4, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

11. The wire connection terminal structure as claimed in claim 3, wherein a protruding back section is disposed on one face of the stopper member distal from the two support legs, the back section being positioned between the two recesses.

12. The wire connection terminal structure as claimed in claim 11, wherein a stop face is formed on the stopper member and directed to a biasing path of the elastic abutment plate, a guide slope being formed at the middle of one face of the stopper member, which faces the socket for deflecting the wire inserted into the socket into the space between the two support legs.

13. The wire connection terminal structure as claimed in claim 12, wherein each support leg is formed with a connecting section outwardly bent from the support leg.

14. The wire connection terminal structure as claimed in claim 12, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

15. The wire connection terminal structure as claimed in claim 11, wherein each support leg is formed with a connecting section outwardly bent from the support leg.

16. The wire connection terminal structure as claimed in claim 15, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

17. The wire connection terminal structure as claimed in claim 11, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

18. The wire connection terminal structure as claimed in claim 3, wherein a stop face is formed on the stopper member and directed to a biasing path of the elastic abutment plate, a guide slope being formed at the middle of one face of the stopper member, which faces the socket for deflecting the wire inserted into the socket into the space between the two support legs.

19. The wire connection terminal structure as claimed in claim 18, wherein each support leg is formed with a connecting section outwardly bent from the support leg.

20. The wire connection terminal structure as claimed in claim 18, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

21. The wire connection terminal structure as claimed in claim 3, wherein each support leg is formed with a connecting section outwardly bent from the support leg.

22. The wire connection terminal structure as claimed in claim 21, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

23. The wire connection terminal structure as claimed in claim 3, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

24. The wire connection terminal structure as claimed in claim 2, wherein a stop face is formed on the stopper member and directed to a biasing path of the elastic abutment plate, a guide slope being formed at the middle of one face of the stopper member, which faces the socket for deflecting the wire inserted into the socket into the space between the two support legs.

25. The wire connection terminal structure as claimed in claim 24, wherein each support leg is formed with a connecting section outwardly bent from the support leg.

26. The wire connection terminal structure as claimed in claim 24, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

27. The wire connection terminal structure as claimed in claim 2, wherein each support leg is formed with a connecting section outwardly bent from the support leg.

28. The wire connection terminal structure as claimed in claim 27, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

29. The wire connection terminal structure as claimed in claim 2, wherein an insulation housing is fitted around the terminal main body, one end of the housing being formed with a perforation in alignment with the socket, two lateral sides of the other end of the housing being formed with lateral notches for the support legs to pass through and extend outwardly therefrom.

30. The wire connection terminal structure as claimed in claim 1, wherein a stop face is formed on the stopper member and directed to a biasing path of the elastic abutment plate, a guide slope being formed at the middle of one face of the stopper member, which faces the socket for deflecting the wire inserted into the socket.

31. The wire connection terminal structure as claimed in claim 30, wherein each support leg is formed with a connecting section outwardly bent from the support leg.

32. The wire connection terminal structure as claimed in claim 30, wherein an insulation housing is fitted around the terminal main body, one end of the housing being formed with a perforation in alignment with the socket, two lateral sides of the other end of the housing being formed with lateral notches for a support leg to pass through and extend outwardly therefrom.

33. The wire connection terminal structure as claimed in claim 1, wherein each support leg is formed with a connecting section outwardly bent from the support leg.

34. The wire connection terminal structure as claimed in claim 33, wherein an insulation housing is fitted around the terminal main body, one end of the housing being formed with a perforation in alignment with the socket, two lateral sides of the other end of the housing being formed with lateral notches for a support leg to pass through and extend outwardly therefrom.

35. The wire connection terminal structure as claimed in claim 1, wherein an insulation housing is fitted around the terminal main body, one end of the housing being formed with a perforation in alignment with the socket, two lateral sides of the other end of the housing being formed with lateral notches for a support leg to pass through and extend outwardly therefrom.

36. The wire connection terminal structure as claimed in claim 1, wherein the terminal main body is made of a metal plate by means of punching and thereafter bending.

* * * * *